US005117512A

United States Patent [19]

Bressler

[11] Patent Number: 5,117,512

[45] Date of Patent: Jun. 2, 1992

[54] URINE SHIELD FOR TOILETS

[76] Inventor: Mark Bressler, 3459 Mill Bridge Dr., Marietta, Ga. 30062

[21] Appl. No.: 733,364

[22] Filed: Jul. 19, 1991

Related U.S. Application Data

[63] Continuation of Ser. No. 548,271, Jul. 5, 1990, abandoned.

[51] Int. Cl.[5] ..... E03D 9/00

[52] U.S. Cl. ..... 4/300.3

[58] Field of Search ..... 4/661, 300.3, 301, DIG. 5

[56] References Cited

U.S. PATENT DOCUMENTS

| | | | |
|---|---|---|---|
| 2,489,967 | 11/1949 | Lavine | 4/DIG. 5 X |
| 2,583,718 | 1/1952 | Walls | 4/661 |
| 2,592,040 | 4/1952 | La Hue | 4/DIG. 5 X |
| 2,703,407 | 3/1955 | Henoch et al. | 4/661 X |
| 2,791,780 | 5/1957 | Krischer | 4/301 X |
| 2,980,919 | 4/1961 | Otto | 4/1 |
| 3,071,778 | 1/1963 | Renshaw | 4/1 |
| 3,914,803 | 10/1975 | Gregorski | 4/1 |
| 3,931,649 | 1/1976 | Jankowski | 4/1 |
| 4,044,405 | 8/1977 | Kreiss | 4/661 |
| 4,060,859 | 12/1977 | Anderson | 4/102 |
| 4,133,062 | 1/1979 | Fulbright | 4/251 |
| 4,744,113 | 5/1988 | Kogut | 4/661 |

FOREIGN PATENT DOCUMENTS

| | | | |
|---|---|---|---|
| 21913 | 12/1907 | Fed. Rep. of Germany . | |
| 590964 | 12/1933 | Fed. Rep. of Germany . | |
| 2088430 | 6/1982 | United Kingdom | 4/300.3 |

*Primary Examiner*—Charles E. Phillips
*Attorney, Agent, or Firm*—Dykema Gossett

[57] ABSTRACT

A urine shield for toilets having a bowl and a rim includes an elongated normally flat body of general rectangular shape and of a resilient material, flexed into a U-shape in plan and projected down into the bowl and includes a plurality of spaced clips and stop flanges which supportably engage over and around the toilet rim to prevent unwanted overspray.

11 Claims, 2 Drawing Sheets

URINE SHIELD FOR TOILETS

This is a continuation of copending application(s) Ser. No. 07/548,271 filed on Jul. 5, 1990 now abandoned.

FIELD OF THE INVENTION

The invention relates to toilets and urinals and, more particularly, to a urine shield removably mounted thereon.

BACKGROUND OF THE INVENTION

Previously, children, mentally retarded people, handicapped persons and persons suffering from lost motor control, or memory or other neuromuscular disorders sometimes have difficulty in accurately directing the flow of urine into toilets with the result that some of the spray goes elsewhere.

The problems has been recognized before and various efforts have been made to provide a shield mechanism of one nature or another which fits upon the toilet bowl in order to overcome and solve this pre-existing problem.

The difficulty with the prior art efforts heretofore has been the involved nature of the constructions employed or the difficulty of assembling such constructions for the special usage purpose and thereafter being able to dismount same for normal usages.

Previously, children and young people, particularly, had difficulty in targeting with similar disastrous results so that efforts have been made to assure that the overspray will be avoided and the total stream directed down into the toilet bowl.

THE PRIOR ART

Listed below are one or more patents illustrative of prior art efforts to solve this problem:

| NUMBER | INVENTOR | DATE OF INVENTION |
|---|---|---|
| 2,980,919 | C. H. Otto, et al | April 25, 1961 |
| 3,071,778 | H. M. Renshaw | January 8, 1963 |
| 3,914,803 | Gary Gregovski | October 28, 1975 |
| 3,931,649 | Ollie F. Jankowski | January 13, 1976 |
| 4,060,859 | Joseph B. Anderson | December 6, 1977 |
| 4,133,062 | B. R. Fulbright, Jr. | January 9, 1979 |
| 4,744,113 | J. J. Kogut | May 17, 1988 |
| GERMAN: 590964 | F. E. Kraub | January 13, 1934 |
| GERMAN: 21,913 | Else Krause | December 5, 1907 |

SUMMARY OF THE INVENTION

An important feature of the present invention is to provide a urine shield adapted for use for toilets or urinals in the nature of a elongated, generally rectangular and flexible body which is flexed into general U-shape in plan and positioned down into the bowl of a toilet and includes a plurality of spaced clips upon its exterior supportably engaging portions of the toilet bowl rim.

As another feature, the present urine shield is normally in a flat condition and when removed from a toilet will reassume a flat planar condition for cleaning, for storage or for portability.

Another feature is to provide an elongated urine shield wherein the body, when flexed, is adapted to fit toilet bowls of various dimensions, size and curvature and adapted for automatic support in an upright position thereon, without any fastening, and which is easily removable.

Another feature is to provide the urine shield designed to prevent overspray of urine at an intended receptacle such as a toilet or urinal or similar trough, where its use may be for the toilet training of youngsters. It may also be employed by the mentally retarded or handicapped persons. It may also be used for geriatrics, including for people who have lost motor control or memory or like Alzheimer's disease or other neuromuscular disorders.

As another feature, the present shield is easily removable from one toilet to another or from one city to another. It is adapted to fit toilets of different shapes and size. In accordance with the present invention, and as another feature, the toilet shield consists of a body made of a bendable or flexible material, such as plastic or rubber or thin metal or neoprene. It should be waterproof and washable and may be made of a disposable material such as a treated paper product soaked in paraffin.

As another feature, the present urine shield may be used as a gag gift, sold in places where you find party favors for 40, 50, 60-year-old birthday fun. The body of the shield may have secured thereto, a clip upon its front surface within may be supported a target, a bull's-eye or a picture or photo or the like.

As an important feature, the normally flat urine shield, when flexed to a generally U-shaped condition in plan, is adapted to cooperatively fit the particular curvature of a toilet bowl interior and be supportably mounted thereon by a plurality of spaced clips attached to lower side portions of the body, or formed as a part of the body, for the purpose of supportably engaging the rim of the toilet bowl, maintaining the shield in an upright position so as to project well above the toilet bowl and its rim and with lower edge portions of the body extending below the rim of the toilet bowl.

As another feature, the present urine shield includes an elongated body of a flexible material which has imprinted thereon an interesting design or a face of interest, a figure or a target or the equivalent as a part of the shield and which, for portions thereof, and throughout part of its outline project above the general top edge of the shield in a life-like manner.

As another feature, the present urine shield will be supportively mounted when flexed to a general U-shape in plan by a plurality of longitudinally-spaced removable clips supportably engaged on edge portions of the shield upon the interior of the toilet bowl and with portions of the clip extending around or operatively engaging top portions of the toilet bowl and its rim.

These and other features and objects will be seen from the following specification and claims in conjunction with the appended drawings.

THE DRAWINGS

Figure 1:
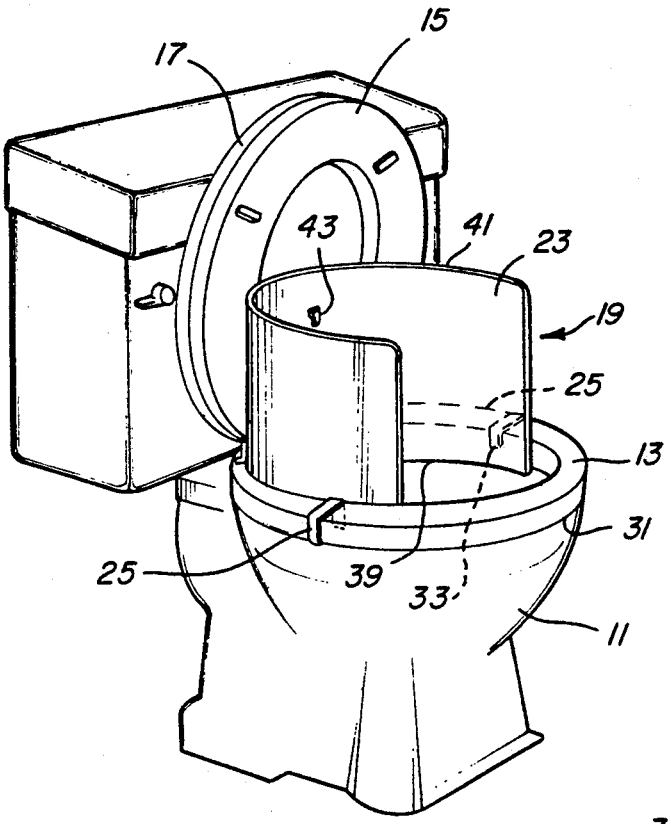
FIG. 1 is a front perspective view of the present urine shield in a use position as mounted upon a toilet bowl.

It will be understood that the above drawings illustrate merely preferred embodiments of the invention, and that other embodiments are contemplated within the scope of the claims hereafter set forth.

DETAILED DESCRIPTION OF AN EMBODIMENT OF THE INVENTION

Referring to the drawings FIGS. 1 through 5, a conventional toilet bowl is designated at 11 having the usual arcuate continuous rim 13 with a conventional seat 15 with seat cover 17. The present invention is directed to a urine shield 19 made of a flexible material such as plastic or rubber or neopren vinyn, a thin metal or a treated paper having a coating of wax or the like of a throw away nature or which is washable.

The present urine shield is adapted for use in conjunction with conventional toilets such as the toilet bowl shown in FIG. 1 or could be used in conjunction with urinals, if there is provided a supporting rim to which the present urine shield may be removably connected.

Figure 4:
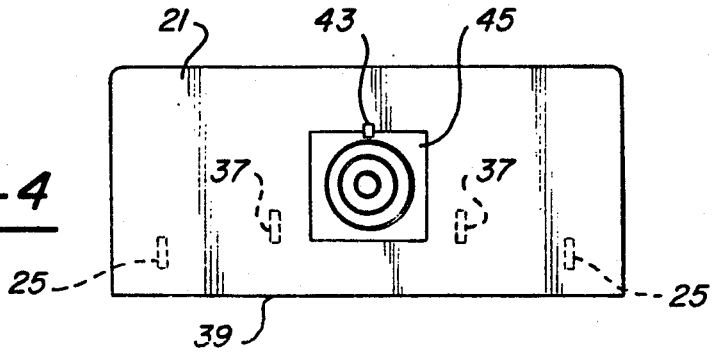
FIG. 4 is a side elevational view of the body of the present urine shield in a normally flat unfolded condition with a target clip thereon.
Figure 5:
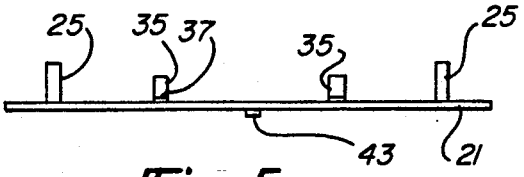
FIG. 5 is a plan view thereof.
Figure 6:
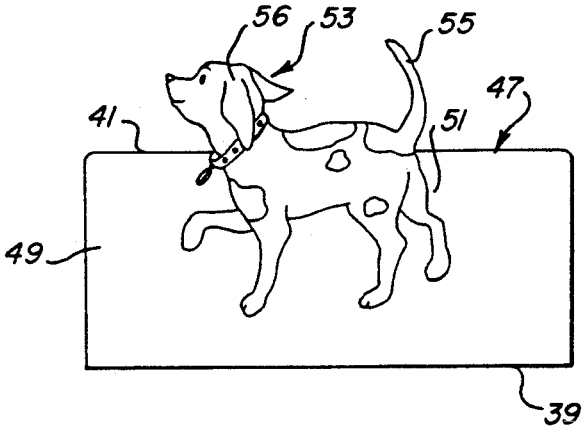
FIG. 6 is a side elevational view of a modified urine shield with a design imprinted thereon with portions of the design standing above the outline of the basic shield as a life-like extension of the imprint thereon.

In accordance with the present application the urinal shield includes an elongated resilient body 21, FIG. 4, which is generally rectangular in shape and made of a flexible material such as plastic and is normally flat, FIGS. 4 and 5.

In use the body 21 is flexed into a general U-shape in plan as at 23, FIG. 1, having inner and outer surfaces bottom edge 39 and top edge 41, curred at its corners.

The present shield, when flexed to the U-shape 23, FIG. 1, is adapted to be inserted in an upright position upon the interior of the rim 13 of toilet bowl 11, FIG. 1. The shield is supported in position by a plurality of spaced clips arranged upon the exterior surface of the body 21, along and adjacent its bottom edge 39 normally above its bottom edge. Said clips supportably overlie the rim 13.

Figure 3:
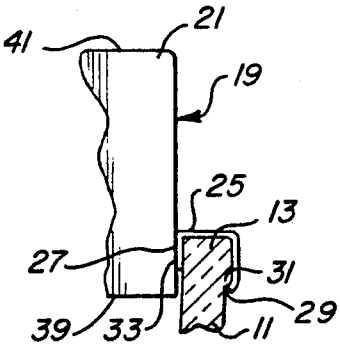
FIG. 3 is a fragmentary section taken the direction of arrows 3—3 of FIG. 2, on an increased scale.

In the illustrated embodiment there are provided a pair of inverted U-shaped clips 25 anchored as by cement at 27, FIG. 3, to outer surface portions of the body 21 above its bottom edge 39. Each of the pair of opposed clips 25 includes an inturned anchor flange 29, which bears against the continuous undercorner 31 spaced from the top edge of rim 13.

The respective spaced clips further include one or a pair of laterally spaced stop flanges 35 having depending mount flanges 37 suitably adhered to exterior surface portions of the body 21 adjacent its lower edge 39 as by cement 33, FIG. 3.

It is contemplated that the respective clips are connected to the outer surface of shield 19. When the body has been flexed from its normally flat position, FIG. 4, to the upright and U-shaped position, FIG. 1, the lower edge 39 of said body extends down into the rim 13 upon bowl 11 with the respective clips 25 and 35 supportably engaging spaced portions of rim 13. One clip 35 may be used.

Applied to the front surface of the body 21, FIG. 4, centrally thereof is a spring clip 43. Target 45 in a form of a bulls'eye or a picture, an object or person is frictionally held by the spring clip 43 on the central portion of body 21.

In a modified form of the present urine shield as shown at 47, there is provided a similar elongated body 49 of general rectangular shape having a bottom longitudinal edge 39 and a top longitudinal edge 41. Applied to the inner surface of the body 49 there is shown an imprint 51. In a present illustration it is in the form of a dog, but could be any design or face of interest or figure or equivalent subject matter.

Body 49 adjacent its top edge 41 has an extension thereon defined by cutout line 55 as an integral part of the body and to further define the remainder of the design imprinted upon the body 49. Thus it appears that the design imprint 51 while it could be completely upon the body 49 is only partly upon the body 49 with an additional portion of the design imprinted upon the body extension 53. Said extension has been cut out at 55 as a continuation of the design and has imprinted such sufficient additional imprints as at 56 to provide a complete unitary design including imprint 51.

In the illustrated embodiment shown in FIGS. 1 through 5, the respective clips 25 and 35 have been secured to the outer surface of the body 21 as by a cement material 33 or a layer of cement, but could be cut out as an integral part of said body.

Figure 7:
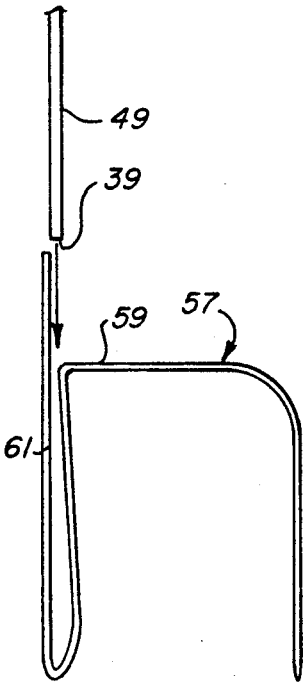
FIG. 7 is a fragmentary side elevational view of a modified clip adapted to supportably engage bottom edge portions of the urine shield so as to overlie the toilet bowl with portions of the shield projecting down into and below the rim thereof with portions of the shield fragmentarily shown.
Figure 8:
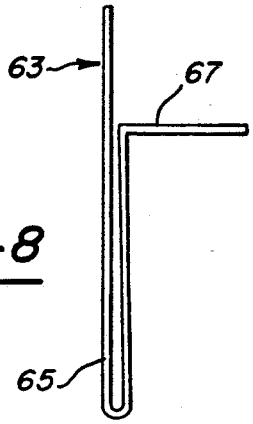
FIG. 8 is a fragmentary side view of a stop clip removably mounted upon spaced intermediate portions of the lower edge of the body and supported upon the toilet rim.
Figure 9:
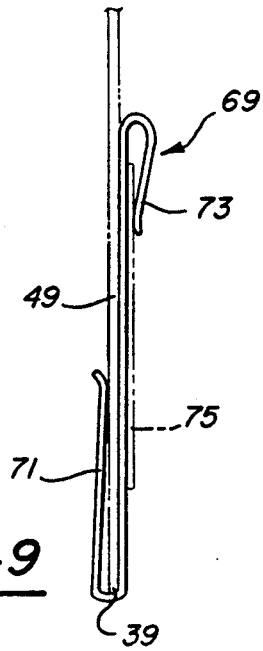
FIG. 9 is a fragmentary side elevational view of a modified clip receiving the bottom edge of the urine shield body for supporting a target or other image thereon.

In the illustrations FIGS. 7, 8 and 9, the respective clips, of wire, or other material are made as separate from the body are formed so as to receive edge portions of the body 49 and to include extension portions so as to supportably overlie portions of the rim 13 of toilet bowl 11.

For this purpose corresponding to the clips 25 of FIG. 1, there is shown the shield mount clip 57 corresponding to the positioning of the hidden clip 25, FIG. 1. Said clip includes an inverted U-shaped base 57 of a resilient material adapted to fit over the bowl rim 13, and terminates in the reverse turned shield support 61. The clip 57 is adapted to receive the lower edge 39 of body 49 at spaced end portions thereof. The respective clips are frictionally secured to the body.

Figure 2:
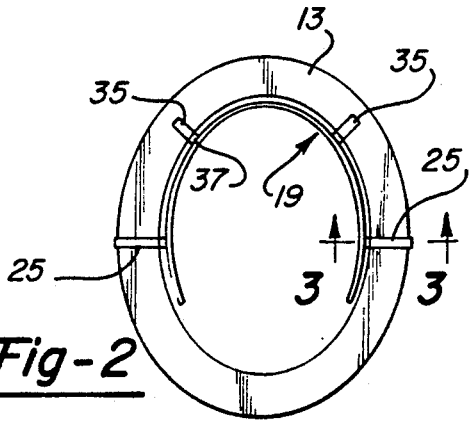
FIG. 2 is a top plan view thereof.

The additional stop clips 63, of which there are one or a pair, correspond to the clips 35 shown in FIG. 2. Each of these clips includes the reverse turned shield holder 65 adapted to receive the bottom edge 39 of the body 49 and terminate in the out-turned stop flange 67. Said flange is adapted to supportably bear upon rim 13 in a manner similar to the corresponding flanges 35, FIGS. 1 and 2. Thus, instead of attaching the clips 25 and 35 permanently to the body 21, FIG. 4, the respective clips 57 and 63 are merely snapped onto the lower edge of the body 49, for illustration, FIGS. 7 and 8, and frictionally retained thereon. With the clips in proper position and with the body flexed to the general U-shape shown in FIG. 1, the body will extend down into toilet bowl 11 within rim 13 and be supported thereon by the respective clips 57 and 63, the same as above described with respect to the clips 25 and 35.

For the spring clip 43 adhered to the front face of body 21 to hold the target 45, FIG. 4, as shown in FIG. 9, the S-shaped resilient clip 69 has a bottom loop 71.

This receives a central bottom edge portion 39 of body 49. The top loop 73 is reverse-turned downwardly adjacent the front central portion of the body 49 and is adapted to frictionally and yieldably hold a top-edge portion of a target 75 or picture similar to the target 45 of FIG. 4. The present urine shield for a toilet as shown at 21 and 47 is normally flat for portability or storage, and for use can be easily flexed into the general U-shape in plan form shown in FIG. 1 for assembly down into the toilet bowl 11 within the rim 13. Said shield is retained thereon in the upright position shown by the plurality of clips 25 and 35 or alternately the corresponding clips 57 and 63.

Referring to FIG. 1, the corresponding end clips 25 retainingly and yieldably engage upper portions of the rim 11 whereas the spaced rear clips 35 supportably bear over the top of the rim.

Urine shield, as a modification, may have in the flexible material of body 21 a fluorescent material, so that it is visible in the dark. Alternately, the body may be coated with such material.

I claim:

1. A toilet comprising:

a bowl having a continuous rim with an inner periphery defining an opening into a bowl chamber, said inner periphery extending for a first distance, said rim being generally at a first vertical position;

a generally planar flexible guard received in said inner periphery, said guard being generally flat in a relaxed position, but being deformed into a generally U-shape within said inner periphery, said guard extending between a lower vertical end upwardly to an upper vertical end, said lower vertical end being below said first vertical position, said guard extending for a second distance between two lateral ends, said second distance being less than said first distance, said guard extending along end abutting the rear of said inner periphery with said lateral ends extending towards the front, said lateral ends being spaced by a third distance which is approximately the difference between said first and second distance;

resilient clips securing said guard to said rim, said clips extending outwardly from said guard to contact an outer periphery of said rim;

an access hole to said opening being defined vertically upwardly from said rim and circumferentially between said lateral ends over said third distance, said access hole allowing a user access for urinating into said opening; and a spring clip disposed upon said guard within the interior of said U-shape, and at a central position between said lateral ends, and a removable target retained upon said guard by said clip.

2. In the urine shield of claim 1, further comprising said clips, including a pair of opposed, reversed turned, upwardly opening shield supports receiving spaced bottom edge portions of said body;

each support terminating in an inverted U-shaped member mounted over spaced portions of said rim; and a pair of laterally spaced U-shaped spring clips mounted over intermediate portions of said bottom edge and terminating in right angular stop flanges supported upon said rim.

3. In the urine shield of claim 1, further comprising said spring-type clip being a S-shape and reverse turned upper and lower portions, its lower portion extending over the lower edge of said body centrally therof, and its upper portion bearing against said body; and a target bearing against said body and retained by said clip.

4. In the urine shield of claim 1, further comprising said clips being formed as a part of said body and extending therefrom.

5. In the urine shield of claim 1, further comprising said clips including a pair of opposed U-shaped clips yieldably secured to said body inwardly of its ends, extending transversely around and engaging said rim; and a pair of spaced stop flanges of L-shape yieldably secured to intermediate portions of said body and supported upon said rim.

6. In the urine shield of claim 5, further comprising the securing of said clips to said body including a cement.

7. In the urine shield of claim 5, said rim having a peripheral undercut ledge below its top;

each of said U-shaped clips, including an inturned anchor flange yieldably engaging said ledge.

8. In the urine shield of claim 1, further comprising an imprint of part of a design or object applied to said body;

a two-dimensional extension of said object projecting from the top edge of the body as a continuation of said design; and an imprint upon said extension forming a part of and completing said design.

9. In the urine shield of claim 1, further comprising an imprint of a design, object or figure applied to said body.

10. In the urine shield of claim 1, said target being a picture.

11. A urine guard for use on a toilet bowl having a continuous rim with an inner periphery defining an opening into a bowl chamber, the inner periphery extending for a first distance and the rim being generally at a first vertical position, the urine guard comprising;

a generally planar flexible guard adapted to be received in the inner periphery, said guard being generally flat in a relaxed position, but being deformed into a generally U-shape when mounted within the inner periphery, said guard extending between a lower vertical end upwardly to an upper vertical end, said lower vertical end being below the first vertical position when the guard is received within the inner periphery, said guard extending for a second distance between two lateral ends, said second distance being less than the first distance, said guard extending along and abutting the rear of the inner periphery with said lateral ends extending towards the front when the guard is received within the inner periphery such that said lateral ends are spaced by a third distance which is approximately the difference between the first and said second distance;

resilient clips for securing said guard to the rim, said clips extending outwardly from said guard for contacting an outer periphery of the rim;

said guard defining an access hole to the opening vertically upwardly from the rim and circumferentially between said lateral ends over said third distance when the guard is received within the inner periphery, said access hole allowing a user access for urinating into the opening; and a spring clip disposed upon said guard within the interior of said U-shape, and at a central position between said lateral ends, and a removable target retained upon said guard by said clip.

* * * * *